US010248059B2

(12) United States Patent
Arakawa

(10) Patent No.: US 10,248,059 B2
(45) Date of Patent: Apr. 2, 2019

(54) FIXATION UNIT AND IMAGE FORMATION APPARATUS

(71) Applicant: Oki Data Corporation, Tokyo (JP)

(72) Inventor: Kojiro Arakawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 26 days.

(21) Appl. No.: 15/787,297

(22) Filed: Oct. 18, 2017

(65) Prior Publication Data

US 2018/0120743 A1 May 3, 2018

(30) Foreign Application Priority Data

Oct. 27, 2016 (JP) ..... 2016-210643

(51) Int. Cl.
*G03G 15/20* (2006.01)

(52) U.S. Cl.
CPC ..... *G03G 15/2053* (2013.01); *G03G 15/2039* (2013.01); *G03G 15/2017* (2013.01)

(58) Field of Classification Search
CPC ..... G03G 15/2017; G03G 15/2039; G03G 15/2053; G03G 15/2075; G03G 15/2078; G03G 2215/2016; G03G 2215/2022; G03G 2215/2025; G03G 2215/2032; G03G 2221/1639
See application file for complete search history.

(56) References Cited

U.S. PATENT DOCUMENTS

2014/0369727 A1* 12/2014 Tsunoda ..... G03G 15/2064 399/329
2015/0220029 A1* 8/2015 Samei ..... G03G 15/2039 399/69
2017/0308010 A1* 10/2017 Okajima ..... G03G 15/2053

FOREIGN PATENT DOCUMENTS

JP 2016-161673 A 9/2016
JP 2017156612 A * 9/2017

* cited by examiner

*Primary Examiner* — Thomas S Giampaolo, II
(74) *Attorney, Agent, or Firm* — Metrolexis Law Group, PLLC

(57) ABSTRACT

A fixation unit according to an embodiment includes: a first roller; a second roller disposed facing the first roller, the first roller pressed against the second roller; an endless heating member that is provided around the second roller and configured to heat developer on a medium while passing through a contact area between the first roller and the second roller; a temperature detector that contacts with the heating member at a position upstream of the contact area in a rotation direction of the heating member and is configured to detect temperature of the heating member; and a discharging member that releases electric charge of the heating member. The discharging member is disposed between the temperature detector and the contact area in the rotation direction of the heating member.

6 Claims, 9 Drawing Sheets

Fig. 9

| PUSH AMOUNT [mm] | ELECTRIC CHARGE AMOUNT [V] | EVALUATION RESULT |
|---|---|---|
| 1.0 | 700 | POOR |
| 0.5 | 500 | GOOD |
| 0.3 | 300 | GOOD |
| 0.0 | 300 | EXCELLENT |
| −0.3 | 300 | GOOD |
| −0.5 | 500 | GOOD |
| −1.0 | 900 | POOR |

Fig. 10

| EFFECT OF STREAK INHIBITION | BELT OUTER/INNER | POSITION RELATIVE TO BELT GUIDE | PUSH AMOUNT [mm] | BRUSH DENSITY [PIECES/mm] |
|---|---|---|---|---|
| POOR | INNER SURFACE | DOWNSTREAM | −0.5～+0.5 | 300 |
| GOOD | INNER SURFACE | DOWNSTREAM | −0.5～+0.5 | 600 |
| EXCELLENT | INNER SURFACE | DOWNSTREAM | −0.5～+0.5 | 900 |

FIXATION UNIT AND IMAGE FORMATION APPARATUS

CROSS REFERENCE TO RELATED APPLICATIONS

This application claims priority based on 35 USC 119 from prior Japanese Patent Application No. 2016-210643 filed on Oct. 27, 2016, entitled "FIXATION UNIT AND IMAGE FORMATION APPARATUS", the entire contents of which are incorporated herein by reference.

BACKGROUND

This disclosure relates to a fixation unit that fixes developer onto a medium, and an image formation apparatus.

A fixation unit according to a related art includes a belt temperature sensor serving as a temperature detector that detects temperature of a fixation belt serving as a heating member for heating developer, and the belt temperature sensor is disposed in sliding contact with the inner peripheral surface of the fixation belt (see Patent Literature 1, for example).

Patent Literature 1: Japanese Patent Application Publication No. 2016-161673

SUMMARY

In the above-mentioned fixation unit, however, streaks occur in a developer image in an area provided with the temperature detector that detects the temperature of the fixation belt. Accordingly, the image quality is degraded.

An aspect of the disclosure is a fixation unit that includes: a first roller; a second roller disposed facing the first roller, the first roller pressed against the second roller; an endless heating member that is provided around the second roller and configured to heat developer on a medium while passing through a contact area between the first roller and the second roller; a temperature detector that contacts with the heating member at a position upstream of the contact area in a rotation direction of the heating member and is configured to detect temperature of the heating member; and a discharging member that releases electric charge of the heating member. The discharging member is disposed between the temperature detector and the contact area in the rotation direction of the heating member.

The aspect makes it possible to inhibit the fixation unit from degrading the image quality.

BRIEF DESCRIPTION OF DRAWINGS

FIG. 9 is an explanatory table illustrating results of evaluating the fixation unit;

FIG. 10 is another explanatory table illustrating results of evaluating the fixation unit;

DETAILED DESCRIPTION

Figure 1:
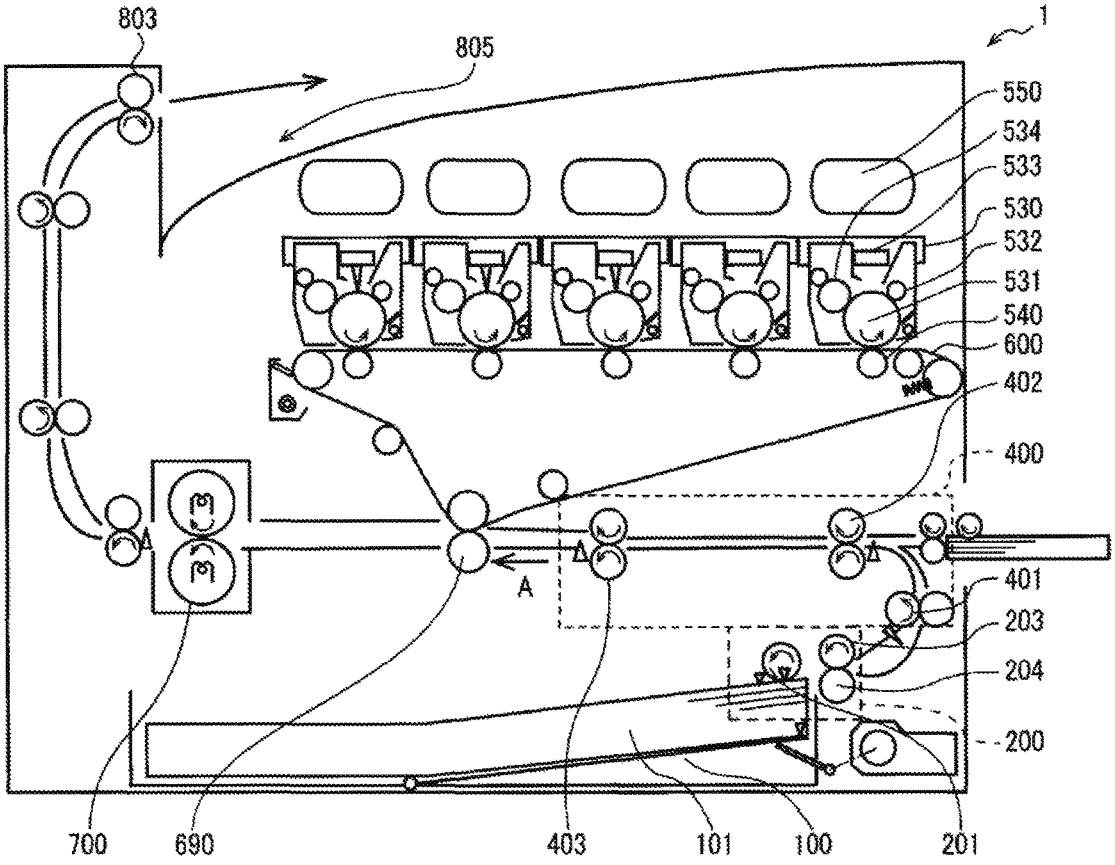
FIG. 1 is a schematic side cross-sectional view illustrating a configuration of an image formation apparatus according to one or more embodiments.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

FIG. 1 is a schematic side cross-sectional view illustrating a configuration of an image formation apparatus according to one or more embodiments. In FIG. 1, the image formation apparatus 1 is, for example, a color printer. The image formation apparatus 1 includes the fixation unit serving as a fixation unit that fixes developers to a medium with heat and pressure after the developers are transferred onto the medium. The image formation apparatus 1 forms and prints an image on a print medium or a special medium. An example of the print medium is plain paper such as wood-free paper. Examples of the special medium include an envelope and thin paper.

The image formation apparatus 1 includes a sheet tray 100, a sheet feeder 200, a sheet conveyance unit 400, toner image formation units 530, toner cartridges 550, an intermediate transfer belt 600, a secondary transfer roller 690, a fixation unit 700, a delivery roller pair 803, and a stacker 805. The image formation apparatus 1 forms and prints an image on a print medium.

The sheet tray 100 contains a stacked pile of sheets 101 as print media. The sheet feeder 200 feeds the sheets 101 contained in the sheet tray 100. The sheet feeder 200 includes: a pick-up roller 201 that picks up the sheets 101; and separation roller pairs 203, 204 that separate the sheets 101, picked up by the pick-up roller 201, on a one-by-one basis.

The sheet conveyance unit 400 conveys the sheet 101 fed from the sheet feeder 200. The sheet conveyance unit 400 includes conveyance roller pairs 401, 402, 403 that convey the sheet 101, separated by the separation roller pairs 203, 204, while holding the sheet 101 between each conveyance roller pair.

There are five toner image formation units 530 detachably disposed side-by-side in the apparatus. The five toner image formation units 530 correspond uniquely to the colors (for example, yellow, magenta, cyan, black and a special color) of the toners as the developers. Each toner image formation unit 530 forms a toner image. Incidentally, although the toner types handled by the toner image formation units 530 are different from one another, the toner image formation units 530 have the same configuration.

Each toner image formation unit 530 includes: a photosensitive drum 531 serving as an image carrier; a charging roller 532 that uniformly charges the surface of the photosensitive drum 531; a light head 533 serving as a light exposure unit that forms a latent image by selectively irradiate the surface of the photosensitive drum 531 with light; and a developing roller 534 that forms the toner image on the photosensitive drum 531 by transporting the toner to the latent image formed on the photosensitive drum 531. Furthermore, a primary transfer roller 540 that transfers the toner image, formed on the photosensitive drum 531, onto the intermediate transfer belt 600 is disposed facing the photosensitive drum 531 with the intermediate transfer belt 600 interposed in between.

This embodiment explains that the toner image formation units 530 are respectively configured to form the five color toner images. However, the toner image formation units 530 are not limited to these configurations, and may form four color toner images, for example, yellow, magenta, cyan and black toner images, or may form a black toner image only.

Each toner cartridge 550 contains the corresponding toner. For each toner color, one toner cartridge 550 is detachably disposed in the corresponding toner image formation unit 530. The toner, contained in the toner cartridge 550, is supplied to the toner image formation unit 530.

The intermediate transfer belt 600 is a rotatable endless belt disposed facing the toner image formation units 530, and conveys the toner images formed in the respective toner image formation units 530. The toner images, formed on the photosensitive drums 531 by the primary transfer rollers 540, are transferred onto the intermediate transfer belt 600.

The secondary transfer roller 690 transfers the toner images, transferred onto the intermediate transfer belt 600, onto the sheet that is being conveyed by the sheet conveyance unit 400 in a sheet conveyance direction indicated with an arrow A in FIG. 1. Note that the combination of the primary transfer rollers 540, transferred onto the intermediate transfer belt 600, and the secondary transfer roller 690 may serve as a transfer unit that transfers the toner images from the photosensitive drums 531 to the sheet. Each of the primary transfer rollers 540 and the secondary transfer roller 690 may serve as a transfer device. This embodiment explains that the image formation apparatus 1 employs the intermediate transfer method in which the toner images, formed on the intermediate transfer belt 600 by the toner image formation units 530, are transferred onto the sheet by the secondary transfer roller 690. However, the image formation apparatus 1 may employ the direct transfer method in which the toner images, formed by the toner image formation units 530, are transferred onto the sheet.

The fixation unit 700 serving as the fixation unit is disposed downstream of the secondary transfer roller 690 in the sheet conveyance direction, and fixes the toner images, transferred onto the sheet, to the sheet with heat and pressure. The delivery roller pair 803 conveys the sheet, having the toner images fixed thereon by the fixation unit 700, while holding the sheet between the delivery roller pair 803, and eventually delivers the sheet to the outside of the apparatus.

The stacker 805 stacks sheets delivered by the delivery roller pair 803. It should be noted that: the image formation apparatus 1 includes a controller such as a central processing unit (CPU); and all the operations of the image formation apparatus 1 is controlled by the controller based on a control program (software) that is stored in a storage unit such as a memory.

Figure 2:
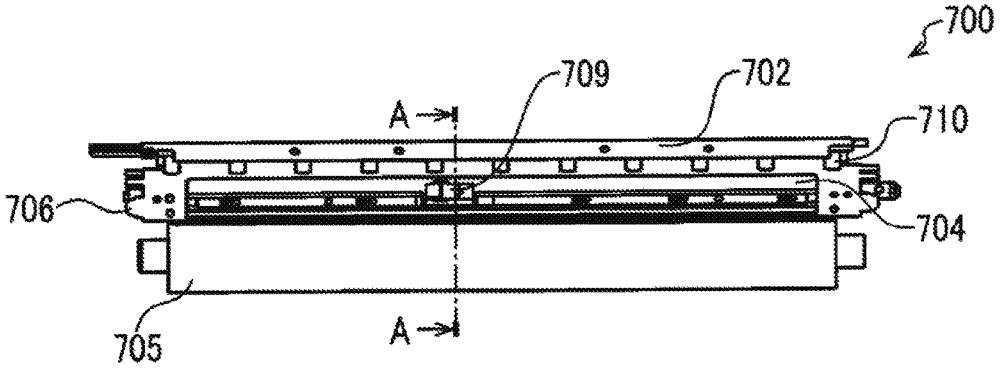
FIG. 2 is a front view of a fixation unit according to an embodiment.
Figure 3:
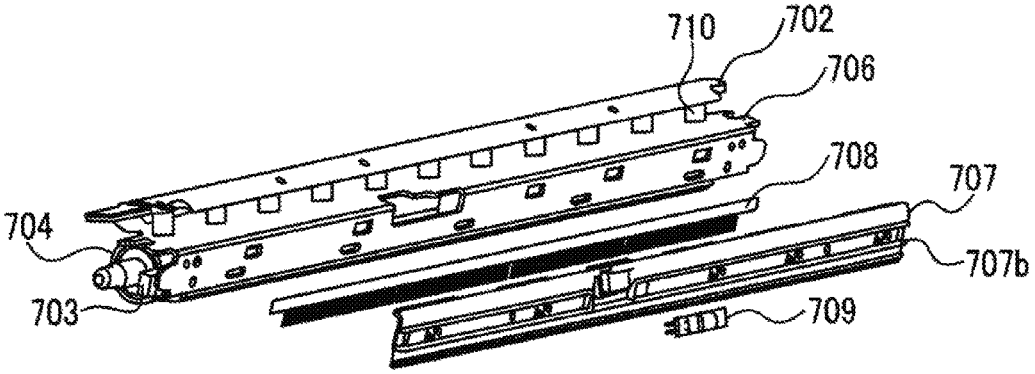
FIG. 3 is an exploded perspective view of the fixation unit.
Figure 4:
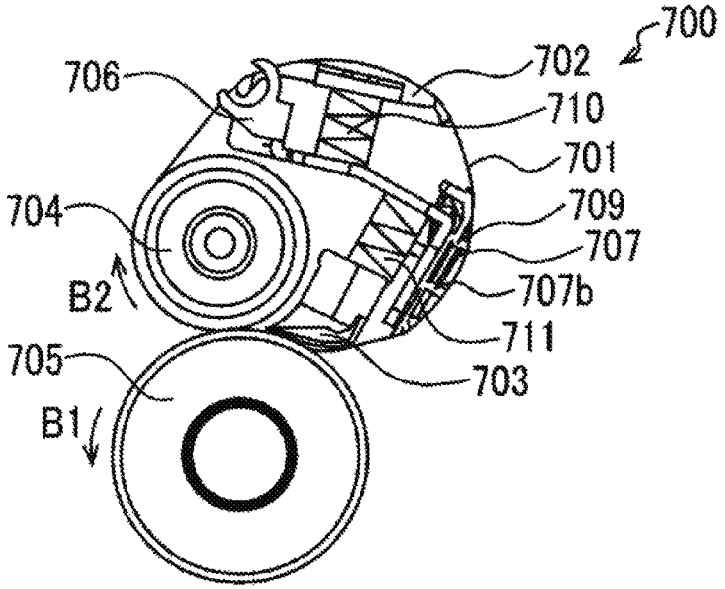
FIG. 4 is a schematic side view of the fixation unit.
Figure 5:
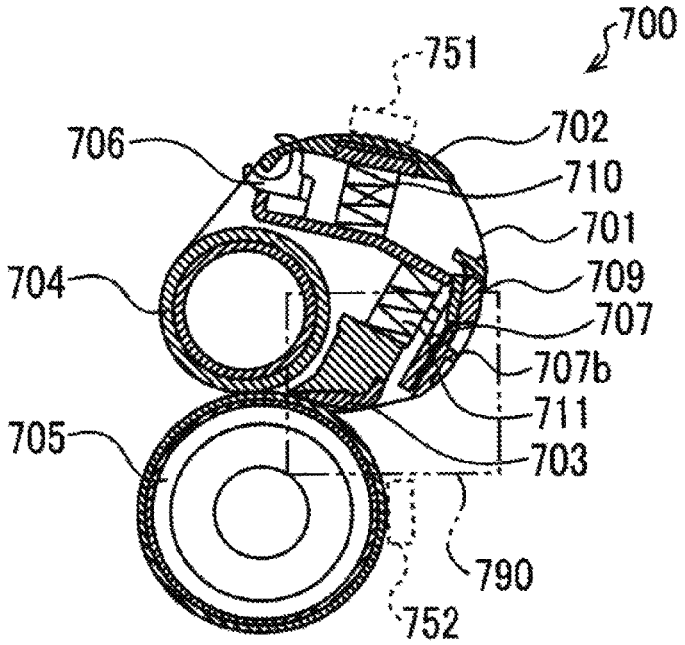
FIG. 5 is a side cross-sectional view of the fixation unit.

FIG. 2 is a front view of the fixation unit of an embodiment. FIG. 3 is an exploded perspective view of the fixation unit. FIG. 4 is a schematic side view of the fixation unit. FIG. 5 is a side cross-sectional view of the fixation unit. Incidentally, FIGS. 2 and 3 illustrate the fixation unit without a fixation belt 701, while FIGS. 4 and 5 illustrate the fixation unit with the fixation belt 701. In addition, FIG. 5 is a cross-sectional view of the fixation unit taken along the A-A line in FIG. 2.

In FIGS. 2 to 5, the fixation unit 700 includes the fixation belt 701, a heater 702, a pressure member 703, a fixation roller 704, a pressure roller 705, a support member 706, a belt guide 707, discharging brushes 708, a temperature detector 709, and springs 710, 711.

The fixation belt 701 serving as a heating member is an endless belt obtained by forming a surface layer (a polytetrafluoroethylene (PFA) layer) on a substrate of polyimide. The fixation belt 701 is stretched among the heater 702, the pressure member 703, the fixation roller 704 and the belt guide 707. The fixation belt 701 is capable of rotating in a rotation direction indicated with an arrow B2 in FIG. 4 In response to the rotation of the fixation roller 704, after passing through a contact area between the pressure roller 705 and the fixation roller 704.

The heater 702 is disposed in contact with the inner side of the fixation belt 701, and supplies heat to the fixation belt 701. The pressure member 703 is disposed upstream of the contact area between the pressure roller 705 and the fixation roller 704 in the rotation direction of the fixation belt 701, and in contact with the pressure roller 705 with the fixation belt 701 interposed between the pressure member 703 and the pressure roller 705. Thus, the pressure member 703 presses the fixation belt 701 against the pressure roller 705.

The pressure roller 705 serving as a first roller is a roller including: a metal-made mandrel; and an elastic layer formed on the outer peripheral surface of the mandrel. The pressure roller 705 is supported rotatable in a direction indicated with an arrow B1 in FIG. 4. The fixation roller 704 serving as a second roller is disposed in contact with the pressure roller 705 with the fixation belt 701 interposed in between.

The fixation roller 704 is a roller including: a metal-made mandrel; and an elastic layer formed on the outer peripheral surface of the mandrel. The shaft of the mandrel is provided with a gear. The fixation roller 704 is supported by the frame of the fixation unit in a way that enables the fixation roller 704 to be rotated in the direction indicated by the arrow B2 in FIG. 4 by rotation of the drive motor. The fixation roller 704 is disposed facing the pressure roller 705. The pressure roller 705 is pressed against the fixation roller 704.

The support member 706 is disposed in the loop of the fixation belt 701, and extends in a width direction orthogonal to the rotation direction of the fixation belt 701. The support member 706 supports the heater 702 and the belt guide 707. The support member 706 is made of an electrically-conductive sheet metal, and its side surface is shaped substantially like the letter L. The two width-direction end portions of the support member 706 are supported by the frame of the fixation unit 700. The support member 706 rotatably supports the two width-direction end portions of the heater 702, and fixes the belt guide 707.

The belt guide 707 serving as a guide member is disposed in the loop of the fixation belt 701, and downstream of the temperature detector 709 in the rotation direction of the fixation belt 701. The belt guide 707 extends in the width direction orthogonal to the rotation direction of the fixation belt 701, and guides the fixation belt 701 in rotation. The belt guide 707 is fixed to one side of the substantially L shape of the support member 706, and is disposed between the fixation belt 701 and the support member 706. The belt guide 707 guides the movement of the fixation belt 701 in rotation while in contact with the inner peripheral surface of the fixation belt 701.

The belt guide 707 includes a rib 707*b* extending in the width direction of the fixation belt 701, and serving as a thin protrusion. The rib 707*b* is in contact with, and slides over, the inner peripheral surface of the fixation belt 701. Thereby, the belt guide 707 guides the movement of the fixation belt 701. This inclusion of the rib 707*b* in the belt guide 707 decreases the contact area between the belt guide 707 and the fixation belt 701, and inhibits transmission of heat to the belt guide 707 from the fixation belt 701 heated by the heater 702.

A support that supports the temperature detector 709 is formed in a center portion of the belt guide 707 in an extension direction of the belt guide 707 (in the width direction of the fixation belt 701). The support projects and supports the temperature detector 709 such that the temperature detector 709 touches the inner peripheral surface of the fixation belt 701.

It is desirable that the material of the belt guide 707 be made of resin or the like that has a relatively low thermal conductivity, and heat resistance. In addition, it is desirable that the material of the belt guide 707 be electrically conductive, because it is necessary to reduce the influence of electric charge caused on the belt guide 707 by friction between the belt guide 707 and the fixation belt 701 in rotation on the fixation of the toner images by the fixation belt 701. For example, the material of the belt guide 707 is polyphenylene sulfide resin (PPS resin) with a predetermined proportion of glass fiber for heat resistance improvement and a predetermined proportion of carbon fiber for providing electrical conductivity included.

The discharging brushes 708 serving as a discharging member are disposed between the temperature detector 709 and the contact area between the pressure roller 705 and fixation roller 704 in the rotation direction of the fixation belt 701. The discharging brushes 708 release the electric charge on the fixation belt 701. To put it in detail, the discharging brushes 708 are disposed between the belt guide 707 and the pressure member 703 in the rotation direction of the fixation belt 701.

Each discharging brush 708 is a bundle of thin electrically-conductive fibers. Multiple discharging brushes 708 are disposed side-by-side in the extension direction of the belt guide 707. Each discharging brush 708 is fixed to the belt guide 707.

Figure 7A:
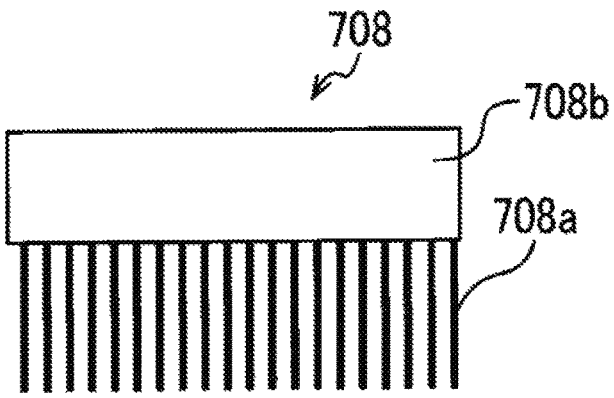
FIGS. 7A and 7B are explanatory diagrams of a discharging brush in the fixation unit.
Figure 7B:
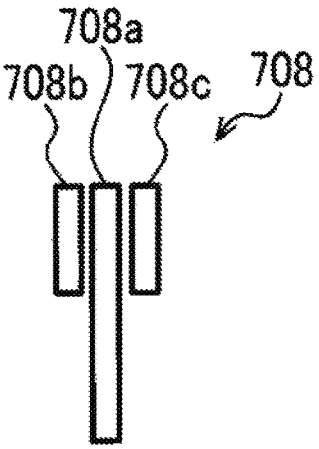

As illustrated in FIGS. 7A and 7B, in the distal end portion of the discharging brush 708, thin electrically-conductive fibers as electrodes 708*a* are bundled, and an end portion of the bundle of the electrodes 708*a* is nipped between the adhesive layers of two tapes 708*b*, 708*c*. FIG. 7A is a front view of one discharging brush 708, and FIG. 7B is a side view of the discharging brush 708.

The fibers of the discharging brush 708 are electrically conductive. Each fiber has a diameter of approximately 8 to 30 μm, which is determined so as to have favorable contact with the fixation belt 701. In this embodiment, the diameter is set at 12 μm. Furthermore, since the electrodes 708*a* are disposed in the loop of the fixation belt 701, the electrodes 708*a* are made of heat-resistant material, for example, stainless steel. An example of the stainless steel is SUS316.

The fibers of each discharging brush 708 are arranged, for example, such that: 100 fibers are tied together into one bundle; multiple bundles are disposed at intervals of 0.33 mm; and the fiber density in the direction orthogonal to the rotation direction of the fixation belt 701 is 300 fibers/mm. If two discharging brushes 708 are disposed in the rotation direction of the fixation belt 701, the fiber density can be 600 fibers/mm. If three discharging brushes 708 are disposed in the rotation direction of the fixation belt 701, the fiber density can be 900 fibers/mm. In this embodiment, the fiber density is set at 600 fibers/mm, or 900 fibers/mm.

Of the two tapes, one tape 708*b* includes an adhesive layer on one surface only, and the other tape 708*c* includes adhesive layers on both surfaces.

One surface of the tape 708*c* of the discharging brush 708 is stuck to the belt guide 707 so that the distal end portion of the electrodes 708*a* is disposed so as to keep a predetermined push amount against the fixation belt 701. The tape 708*b* is a single-sided tape. Since the tape 708*b* is required to be heat-resistive and electrically conductive, the substrate of the tape 708*b* is made of aluminum, and the adhesive layer of the tape 708*b* is made of acrylic electrically-conductive adhesive. Meanwhile, the tape 708*c* is a double-sided tape. The adhesive layers of the tape 708*c* are made of acrylic electrically-conductive adhesive, too.

In this embodiment, the thickness of the aluminum substrate is at 0.08 mm, the thickness of each adhesive layer is at 0.025 mm, and the thickness of the electrode 708*a* and the tapes 708*b*, 708*c* in total is at approximately 0.25 mm. It should be noted that the materials of the electrode 708*a* and the tapes 708*b*, 708*c* of the discharging brush 708 are not limited to those mentioned above, as long as the materials satisfy the required performance such as the heat resistance and the electrical conductivity. Furthermore, the discharging brush 708 is grounded via the belt guide 707 and the support member 706.

The temperature detector 709 is a temperature sensor provided in an extension-direction center portion of the belt guide 707. The temperature detector 709 is disposed upstream of the contact area between the pressure roller 705 and the fixation roller 704 in the rotation direction of the fixation belt 701. The temperature detector 709 touches the inner surface of the fixation belt 701, and detects the temperature of the fixation belt 701. The temperature detector 709 includes a temperature detecting element (for example, a thermistor) having a characteristic in which a resistance value of the element changes depending on the temperature of the element. The temperature detector 709 detects the temperature of the fixation belt 701 by detecting the resistance value of the temperature detecting element.

The temperature detector 709 is disposed in contact with the inner surface of the fixation belt 701. Protective tape covers the temperature detector 709 in order to protect the temperature detector 709 from sliding friction between the temperature detector 709 and the fixation belt 701 in motion. It is desirable that the protective tape be thin with accuracy of detecting a change in temperature around the temperature detecting element taken into consideration. It is also desirable that the protective tape be nonconductive. The protective tape is a film made of polyimide resin (PI resin), and having a thickness of approximately 50 μm. The protective tape includes an adhesive layer that fixes the film to the temperature detecting element.

The heater 702, the belt guide 707, the pressure member 703 and the fixation roller 704 are disposed in the loop of the fixation belt 701 in order from the upstream side in the rotation direction of the fixation belt 701, indicated with the arrow B2 in FIG. 4. The fixation belt 701 is heated by the heater 702, and in turn, heats the toners transferred onto the sheet.

The spring 710 serving as a biasing member biases the heater 702 in a direction in which the heater 702 is pressed against the fixation belt 701. The spring 711 serving as another biasing member biases the pressure member 703 in a direction in which the pressure member 703 is pressed against the pressure roller 705.

The belt guide 707 serving as a guide member is supported by the support member 706 that supports the pressure member 703. The belt guide 707 stretches the fixation belt 701. The belt guide 707 is disposed in contact with the inner side of the fixation belt 701. The pressure member 703 is disposed between the belt guide 707 and the fixation roller 704. Next, descriptions are provided for the push amount of the distal end portion of the electrode 708*a* of the discharging brush 708 against the fixation belt 701.

Figure 6A:
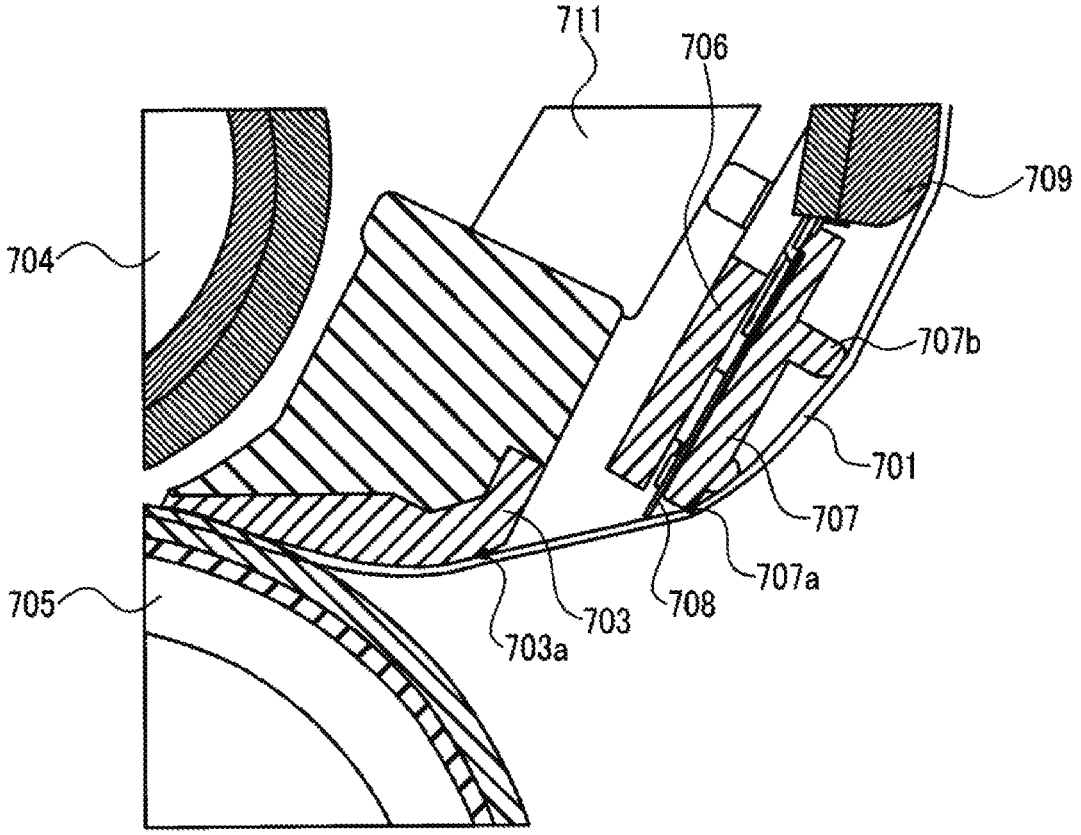
FIGS. 6A and 6B are side cross-sectional views of a main part of the fixation unit.
Figure 6B:
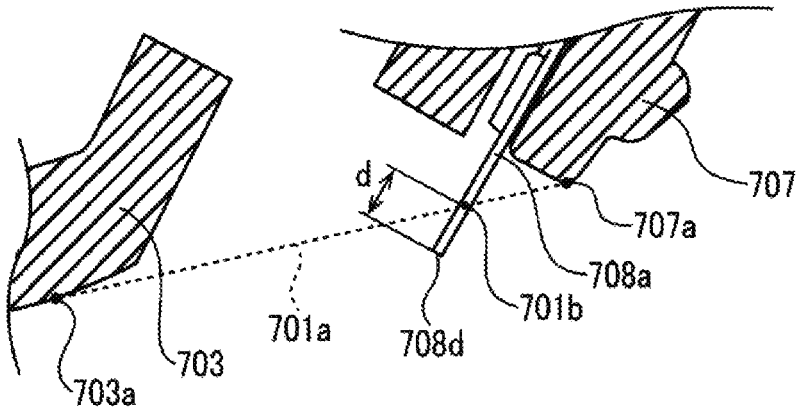

FIGS. 6A and 6B are side cross-sectional views of a main part of the fixation unit. Incidentally, FIG. 6A is a magnified view of an area 790 in FIG. 5, and FIG. 6B is an explanatory diagram for explaining the push amount of the distal end portion of the electrodes 708*a* against the fixation belt 701. In FIGS. 6A and 6B, a stretched suspension point 703*a* represents a point of contact between the pressure member 703 and the fixation belt 701; a stretched suspension point 707*a* represents a point of contact between the belt guide 707 and the fixation belt 701; and a straight line 701*a* represents a straight line joining the stretched suspension point 703*a* and the stretched suspension point 707*a*. Furthermore, an intersection point 701 b represents a point where the electrode 708*a* of the discharging brush 708 crosses the straight line 701*a*.

As illustrated in FIG. 6B, a push amount d of the distal end portion of the electrode 708*a* of the discharging brush 708 against the fixation belt 701 is a distance between the distal end portion 708*d* of the electrode 708*a* and the intersection point 701*b*. In other words, in the side cross section of the fixation unit, the push amount d is a length by which the distal end portion of the electrode 708*a* of the discharging brush 708 projects beyond the straight line 701*a* joining the contact point between the fixation belt 701 and the pressure member 703 (stretch point 703*a*) and the contact point between the fixation belt 701 and the belt guide 707 (stretch point 707*a*).

In this embodiment, the push amount d is set in a range of minus 0.5 mm to plus 0.5 mm. Here, a plus push amount d means that the distal end portion 708*d* of the electrode 708*a* pushes the fixation belt 701 outward after contacting the fixation belt 701 at the intersection point 701*b*. A minus push amount d means that the distal end portion 708*d* of the electrode 708*a* is away from the intersection point 701*b* (namely, the fixation belt 701).

Descriptions are provided for how the above-discussed configuration works. First of all, based on FIG. 1, descriptions are provided for an outline of the printing operation to be performed by the image formation apparatus. For example, upon receipt of print data from an external apparatus, the image formation apparatus 1 generates image data by analyzing the received print data, and sends the image data and a print instruction to the controller. Upon receipt of the print instruction, the controller starts an image formation process, and thereby starts the printing operation.

The image forming process is performed as follows. In each image forming unit 530, an electrostatic latent image is formed on the photosensitive drum 531 by the LED head 533. The toner image is developed by the image forming unit 530. The toner image is primary-transferred onto the intermediate transfer belt 600 by the primary transfer roller 540. After primary-transferred onto the intermediate transfer belt 600, the toner image proceeds to the secondary transfer section, where the toner image is secondary-transferred by the secondary transfer roller 690 onto the sheet 101 that is fed by the sheet feeder 200 and thereafter conveyed by the sheet conveyance unit 400 to the secondary transfer section.

After secondary-transferred onto the sheet 101, the toner image proceeds to the fixation unit 700. The toner image is fixed to the sheet 101 by heat and pressure in the fixation unit 700. The sheet 101 having the toner image fixed thereon is delivered by the delivery roller pair 803 to the outside of the apparatus, and is stacked on the stacker 805. In the above-discussed way, the image formation apparatus 1 performs the printing operation.

Next, based on FIG. 5, descriptions are provided for the fixation operation to be performed by the fixation unit. The fixation roller 704 rotates by being rotationally driven by the drive source such as a motor. In response to the rotation of the fixation roller 704, the fixation belt 701 moves, and the pressure roller 705 also rotates. In this occasion, the heater 702 supplies heat to the fixation belt 701.

While in this state, the pressure roller 705, the fixation roller 704, the pressure member 703 and the fixation belt 701 jointly form a pressure nipper. Once the sheet with toner transferred thereon is conveyed to the pressure nipper, the toner on the sheet is fused with heat and pressure, and thereby is fixed to the sheet. Next, based on FIGS. 8A and 8B, descriptions are provided for results of measuring electrical potentials that are generated on the fixation belt and the pressure roller of the fixation unit when the fixation belt is rotated.

It should be noted that while the fixation belt is being idly rotated with no sheet conveyed, the electrical potential on the outer peripheral surface of the fixation belt 701 is measured at a position 751 facing the heater 2 illustrated in FIG. 5, and the electrical potential on the outer peripheral surface of the pressure roller 705 is measured at a position 752 illustrated in FIG. 5. In addition, the electrical potential on the outer peripheral surface of the fixation belt 701 and the electrical potential on the outer peripheral surface of the pressure roller 705 are measured at a position on the fixation unit 700 illustrated in FIG. 2 in the width direction of the fixation belt 701 where the temperature detector 709 is disposed, and at a position on the fixation unit 700 where no temperature detector 709 is disposed.

Figure 8A:
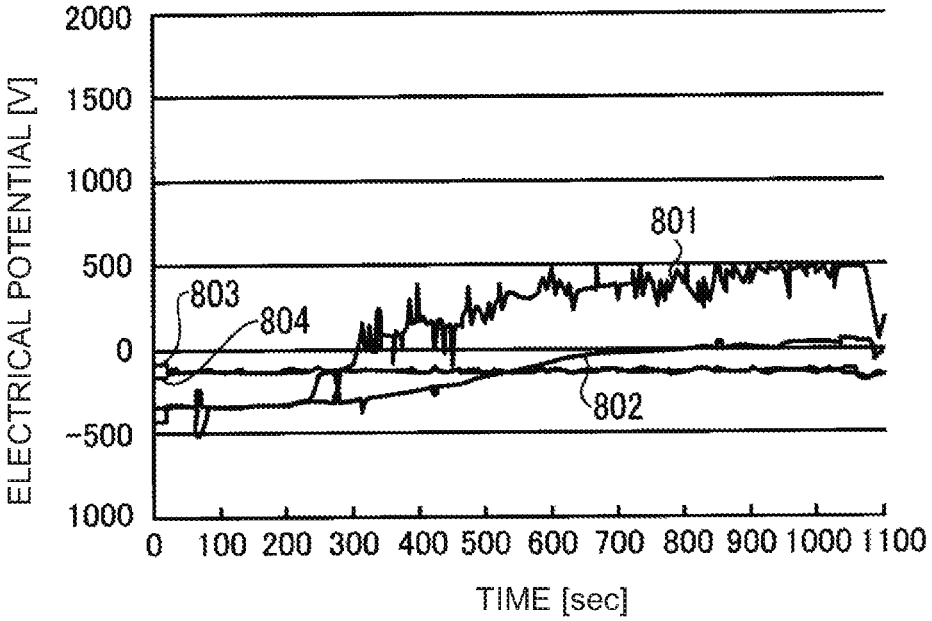
FIG. 8A is a graph illustrating results of measuring electrical potentials on a pressure roller in a case where the fixation unit is provided with discharging brushes, and FIG. 8B a graph illustrating results of measuring electrical potentials on the pressure roller in a case where the fixation unit is provided with no discharging brush.
Figure 8B:
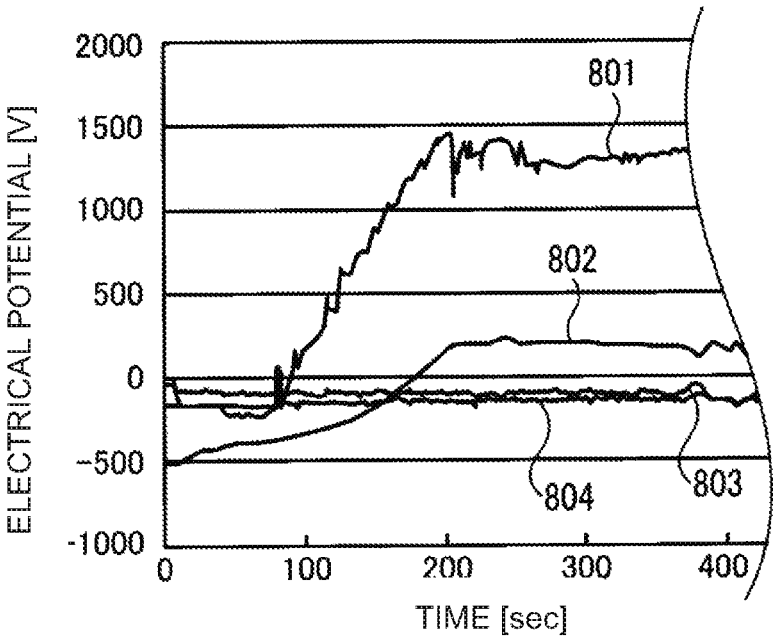

In addition, FIG. 8A is a graph illustrating the results of measuring the above-mentioned electrical potentials in a case where the fixation unit 700 is provided with the discharging brushes 708 with a density of 600 fibers/mm, and FIG. 8B is a graph illustrating the results of measuring the above-mentioned electrical potentials in a case where the fixation unit 700 is provided with no discharging brush.

In FIGS. 8A and 8B, an electrical potential change 801 represents a change in electrical potential on the outer peripheral surface of the fixation belt 701 at the position 751 illustrated in FIG. 5, and at the position where the temperature detector 709 is disposed; an electrical potential change 802 represents a change in electrical potential on the outer peripheral surface of the pressure roller 705 at the position 752 illustrated in FIG. 5, and the position where the temperature detector 709 is disposed; an electrical potential change 803 represents a change in electrical potential on the outer peripheral surface of the fixation belt 701 at the position 751, and at the position where no temperature detector 709 is disposed; and an electrical potential change 804 represents a change in electrical potential on the outer peripheral surface of the pressure roller 705 at the position 752, and at the position where no temperature detector 709 is disposed.

Furthermore, the vertical axis represents the measured electrical potential (V), and the horizontal axis represents how many seconds the fixation belt 701 continues rotating. As illustrated in FIG. 8A, in the case where the fixation unit 700 is provided with the discharging brushes 708, the electrical potential changes 801, 802, 803, 804 do not exceed +500 V even though the fixation belt 701 is rotated for 1000 seconds. Good results are obtained from the electrical potentials on the fixation belt 701 and the pressure roller 705 at each measurement position.

On the other hand, as illustrated in FIG. 8B, in the case where the fixation unit 700 is provided with no discharging brush 708, the electrical potential change 801 exceeds +500 V when the rotation time of the fixation belt 701 reaches approximately 120 seconds, and the electrical potential on the fixation belt 701 rises. The rise in the electrical potential on the surface of the fixation belt 701 like this oxidizes and thus worsens the surface layer of the fixation belt 701 through an electrical discharge phenomenon. Accordingly, the releasability of the toner from the fixation belt 701 deteriorates. As a result, streaks occur in the toner images transferred onto the sheet, and the image quality becomes worse.

Meanwhile, the electrical potential change 803 does not exceed +500 V, and no rise in the electrical potential is observed on the fixation belt 701. From these, it is learned that the electrical potential on the outer peripheral surface of the fixation belt 701 rises only at the position where the temperature detector 709 is disposed. In this embodiment, the discharging brushes 708 are provided downstream of the temperature detector 709, and upstream of the contact area between the fixation roller 704 and the pressure roller 705, in the rotation direction of the fixation belt 701 in the fixation unit 700, in the above-mentioned way, so that it is possible to suppress the rise in the electrical potentials on the fixation belt 701 and the pressure roller 705.

Accordingly, it is possible to inhibit the oxidization and deterioration in the surface layer of the fixation belt 701, and the decrease in the releasability of the toners from the fixation belt 701. For this reason, it is possible to inhibit the occurrence of streaks in the toner images, and thus the degradation in the image quality. It should be noted that no good evaluation results are obtained in the case where the electrodes 708*a* of the discharging brushes 708 are disposed in contact with the outer peripheral surface of the fixation belt 701, and in the case where the electrodes 708*a* thereof are disposed upstream of the belt guide 707 in the rotation direction of the fixation belt 701.

Furthermore, as illustrated in FIG. 9, in a case where the push amount of the electrodes 708*a* (a density of 600 fibers/mm) of the discharging brushes 708 is changed from plus 1.0 mm to minus 1.0 mm, a good evaluation result of the electrical potential (electric charge amount) on the fixation belt 701 is obtained when the push amount is in a range of plus 0.5 mm to minus 0.5 mm. Particularly when the push mount is at 0.0 mm, an evaluation result "excellent" is obtained from the electrical potential (electric charge amount) on the fixation belt 701 even though the fixation belt 701 is continuously rotated.

Next, as illustrated in FIG. 10, in a case where the density (brush density) of the electrodes 708*a* of the discharging brushes 708 is changed while the push amount is in a range of minus 0.5 mm to plus 0.5 mm, good evaluation results are obtained when the brush density is 600 fibers/mm or more. Particularly when the brush density is set at 900 fibers/mm, an evaluation result "excellent" is obtained from the electrical potential (electric charge amount) on the fixation belt 701 even though the push amount is an amount other than 0.0 mm.

In this embodiment, the diameter of each fiber included in the electrodes 708*a* of the discharging brush 708 is set at 12 μm. Instead, even when the diameter is set in a range of 8 to 30 μm, good evaluation results are obtained. Incidentally, when the diameter of each fiber included in the electrodes 708*a* of the discharging brush 708 is set at 40 μm, the electrical potential on the fixation belt 701 exceeds plus 500 V, and no good evaluation result is obtained.

As discussed above, in this embodiment, the discharging brushes 708 are disposed between the temperature detector 709 and the contact area between the fixation roller 704 and the pressure roller 705 in the rotation direction of the fixation belt 701. This makes it possible to inhibit: the rise in the electrical potentials on the fixation belt 701 and the pressure roller 705; and the occurrence of streaks in the toner images at the area provided with the temperature detector 709, so that the fixation unit 700 can be inhibited from degrading the image quality.

Figure 11A:
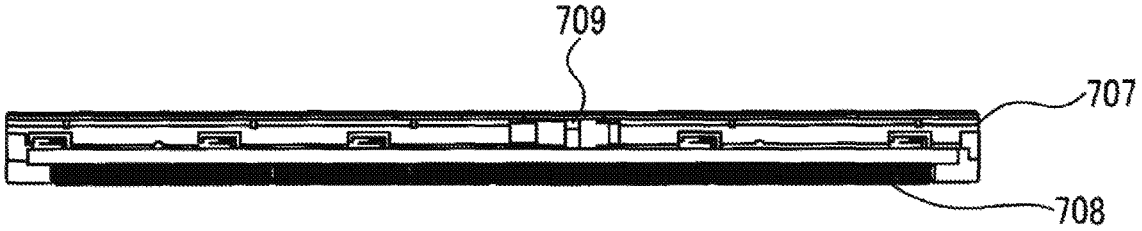
FIGS. 11A and 11B are explanatory views of the discharging brushes in the fixation unit.
Figure 11B:
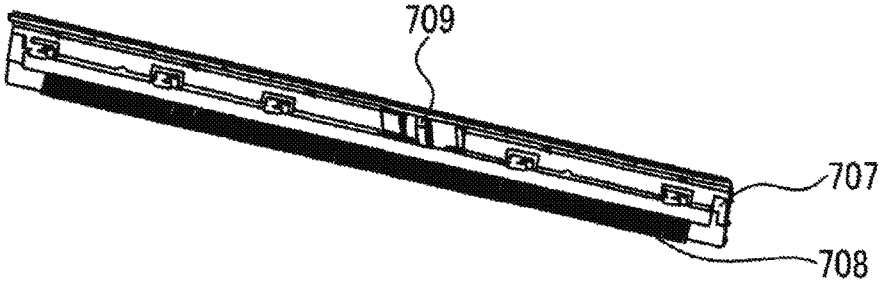
Figure 12A:
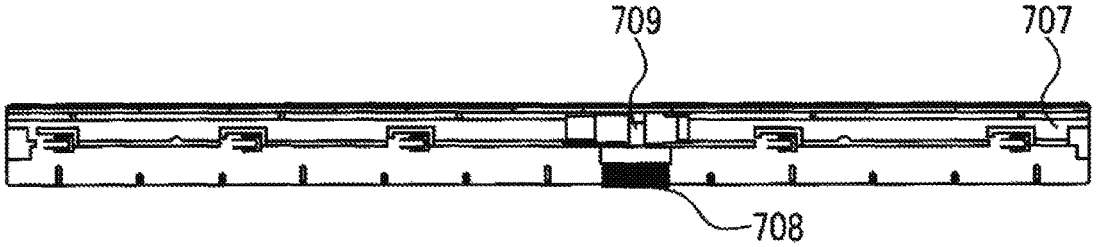
FIGS. 12A to 12C are explanatory views of modifications of the discharging brush.
Figure 12B:
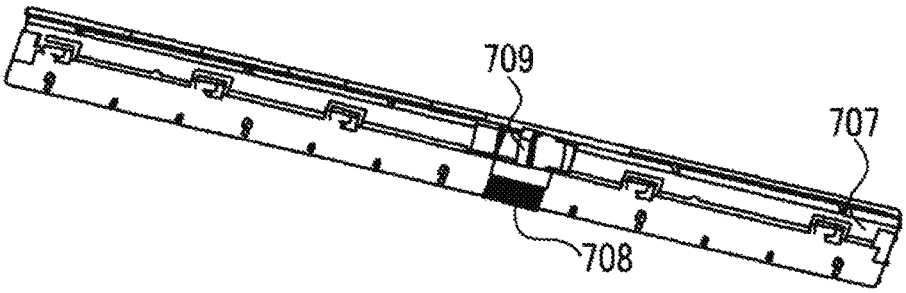
Figure 12C:
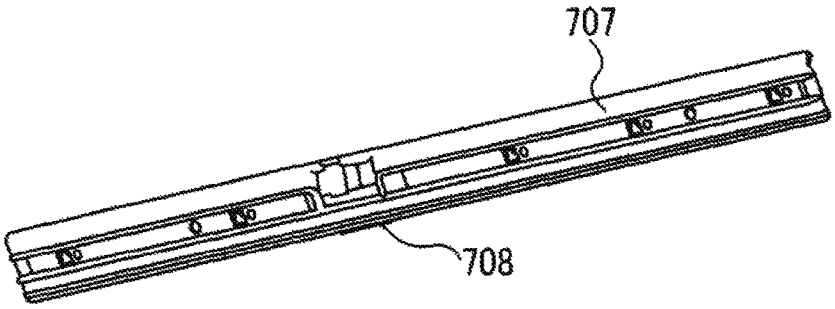

In this embodiment, as illustrated FIGS. 11A and 11B, the discharging brushes 708 are disposed in the full length of the belt guide 707 in the extension direction of the belt guide 707. As illustrated in FIGS. 12A to 12C, however, the discharging brushes 708 may be disposed only at positions corresponding to the temperature detector 709 in the extension direction of the belt guide 707 (in the direction orthogonal to the rotation direction of the fixation belt 701). Incidentally, FIGS. 11A and 12B are plan views of the belt guide 707 and the discharging brushes 708, and FIGS. 11B, 12B and 12C are perspective views of the belt guide 707 and the discharging brushes 708.

As discussed above, in this embodiment, since the discharging brushes are disposed between the temperature detector and the contact area between the fixation roller and the pressure roller in the rotation direction of the fixation belt, it is possible to obtain the effect of inhibiting the fixation unit from degrading the image quality. It should be noted that although the embodiment is explained using the case where the image formation apparatus is a color printer, the image formation apparatus is not limited thereto, and may be any of a copying machine, a facsimile machine, a multifunctional processing machine (MFP), and a monochrome printer.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A fixation unit comprising:

a first roller;

a second roller disposed facing the first roller, the first roller pressed against the second roller;

an endless heating member that is provided around the second roller and configured to heat developer on a medium while passing through a contact area between the first roller and the second roller;

a temperature detector that contacts with the heating member at a position upstream of the contact area in a rotation direction of the heating member and is configured to detect temperature of the heating member; and a discharging member that releases electric charge of the heating member, wherein the discharging member is disposed between the temperature detector and the contact area in the rotation direction of the heating member, a guide member disposed downstream of the temperature detector in the rotation direction of the heating member and configured to guide the heating member; and a pressure member disposed upstream of the contact area in the rotation direction of the heating member and configured to press the heating member against the first roller, wherein the discharging member is disposed between the guide member and the pressure member in the rotation direction of the heating member, the discharging member is disposed to keep a predetermined push amount against the heating member, in a side cross section of the fixation unit, the push amount is a length by which a distal end portion of the discharging member protrudes beyond a straight line joining a contact point between the heating member and the pressure member and a contact point between the heating member and the guide member, and the push amount falls within a range of minus 0.5 mm to plus 0.5 mm, inclusive.

2. The fixation unit according to claim 1, wherein the distal end portion of the discharging member is made of a fiber member, and a density in the fiber member in a direction orthogonal to the rotation direction of the heating member is 600 fibers/mm or more.

3. The fixation unit according to claim 1, wherein the discharging member is disposed at a position corresponding to the temperature detector in a direction orthogonal to the rotation direction of the heating member.

4. An image formation apparatus comprising the fixation unit according to claim 1.

5. An image formation apparatus comprising:

a toner image formation unit that forms a toner image;

a transfer unit that transfers the toner image onto a print medium; and the fixation unit according to claim 1 that fixes the toner image to the print medium.

6. The fixation unit according to claim 1, wherein the discharging member is disposed inside of the endless heating member and in contact with an inner circumferential surface of the endless heating member.

* * * * *